US009920395B2

(12) United States Patent
Davis et al.

(10) Patent No.: US 9,920,395 B2
(45) Date of Patent: Mar. 20, 2018

(54) METHOD FOR RECOVERING GOLD FROM REFRACTORY ORE

(71) Applicant: Ecolab USA Inc., St. Paul, MN (US)

(72) Inventors: Ronald V. Davis, Geneva, IL (US); Daniel E. Child, Spring Creek, NV (US); Walter Gerlach, Naperville, IL (US)

(73) Assignee: Ecolab USA Inc., St. Paul, MN (US)

( * ) Notice: Subject to any disclaimer, the term of this patent is extended or adjusted under 35 U.S.C. 154(b) by 246 days.

(21) Appl. No.: 14/856,277

(22) Filed: Sep. 16, 2015

(65) Prior Publication Data

US 2016/0083816 A1 Mar. 24, 2016

Related U.S. Application Data

(60) Provisional application No. 62/054,804, filed on Sep. 24, 2014.

(51) Int. Cl.

| | |
|---|---|
| ***C22B 1/02*** | (2006.01) |
| ***C22B 1/26*** | (2006.01) |
| ***C22B 11/00*** | (2006.01) |
| ***C22B 3/00*** | (2006.01) |
| ***C22B 11/08*** | (2006.01) |

(52) U.S. Cl.

CPC ..... *C22B 1/26* (2013.01); *C22B 1/02* (2013.01); *C22B 11/04* (2013.01); *C22B 11/08* (2013.01)

(58) Field of Classification Search

CPC .. C21B 1/02; C21B 1/26; C21B 11/04; C21B 11/08; C21B 3/12; C21B 3/04; C22B 1/02; C22B 1/26; C22B 11/04; C22B 11/08; C22B 3/12; C22B 3/04

See application file for complete search history.

(56) References Cited

U.S. PATENT DOCUMENTS

| | | | | |
|---|---|---|---|---|
| 4,552,589 A | | 11/1985 | Mason et al. | |
| 4,961,777 A | | 10/1990 | Perez et al. | |
| 5,116,417 A | * | 5/1992 | Walker, Jr. | C22B 11/08 106/710 |
| 5,320,720 A | * | 6/1994 | Hayden | C22B 11/08 205/569 |
| 6,482,373 B1 | * | 11/2002 | Hannaford | C22B 1/02 423/27 |

(Continued)

FOREIGN PATENT DOCUMENTS

| | | | |
|---|---|---|---|
| EP | 0 508 542 A2 | | 10/1992 |
| WO | WO 2013019627 A | * | 2/2013 |

OTHER PUBLICATIONS

Chen, T. T., et al., "Characterizing Gold in Refractory Sulfide Gold Ores and Residues," JOM, Dec. 2002, pp. 20-22, vol. 54, No. 12.

(Continued)

*Primary Examiner* — George Wyszomierski
*Assistant Examiner* — Tima M McGuthry Banks
(74) *Attorney, Agent, or Firm* — Senniger Powers LLP

(57) ABSTRACT

A method of recovering gold from refractory ore containing a carbonaceous material, a sulfide and gold is provided. Gypsum seed crystals are added to a slurry containing a roasted refractory ore or a pressure-oxidized refractory ore to decrease gypsum encapsulation of gold and improve gold recovery.

20 Claims, 3 Drawing Sheets

(56) References Cited

U.S. PATENT DOCUMENTS

| | | | | |
|---|---|---|---|---|
| 6,833,021 | B1 * | 12/2004 | Hourn | C22B 11/04 423/22 |
| 7,922,788 | B2 | 4/2011 | Hillier et al. | |
| 8,623,115 | B2 | 1/2014 | Langhans, Jr. et al. | |
| 2004/0156765 | A1 | 8/2004 | Lalancette | |
| 2006/0133974 | A1 | 6/2006 | Ji et al. | |
| 2012/0128528 | A1 * | 5/2012 | Langhans, Jr. | C22B 3/24 420/463 |

OTHER PUBLICATIONS

International Search Report and Written Opinion issued for PCT/US2015/050423, dated Nov. 19, 2015, 11 pages.

* cited by examiner

METHOD FOR RECOVERING GOLD FROM REFRACTORY ORE

CROSS-REFERENCE TO RELATED APPLICATION

This application claims the benefit of U.S. Provisional Patent Application Ser. No. 62/054,804, filed Sep. 24, 2014, the entirety of which is incorporated herein by reference.

FIELD OF THE INVENTION

The present invention generally relates to methods of improving recovery of gold from refractory ore. More specifically, the methods improve gold recovery from roasted refractory ores or pressure-oxidized refractory ores.

BACKGROUND OF THE INVENTION

Gold ores are either free milling or refractory. Free-milling ores can be processed by gravity techniques or direct cyanidation. Refractory ores are not effectively processed by these techniques, and are more difficult to process since precious metals such as gold are often occluded or encapsulated within sulfide minerals, carbonaceous matter, or siliceous minerals of the ore. The distribution of gold within the ore can vary considerably from one ore to another. Refractory ores can be ores, flotation concentrates, mill tailings, and other reserves from mining operations.

In conventional processes, the carbon- and sulfur-containing components of refractory ores, such as organic and inorganic carbonaceous materials and sulfidic minerals, respectively, are oxidized during roasting or pressure-oxidative autoclaving of the refractory ore. The roasted or pressure-oxidized ore is subjected to cyanide leaching followed by a gold recovery process since gold combines with cyanide to form a complex. However, residual carbon (known as calcine) or clay materials such as illite, kaolin, and montmorillonite adsorb the gold-cyanide complex (a phenomenon known as "preg robbing"). This phenomenon can reduce precious metal recovery during cyanide leaching. Gold is extracted from the cyanide leach solution by conventional means (e.g., zinc dust precipitation process, carbon-in pulp process, carbon in-leach process, or flotation-roasting leaching).

After the ore is roasted or subjected to pressure-oxidative autoclaving, the ore is quenched with process water and a portion of the gold grains can become coated with gypsum. This can also occur during subsequent pH adjustment with lime or another alkali. Since gypsum is not susceptible to dissolution by alkaline cyanide, the gold grains that are "encapsulated" by gypsum are not solubilized during cyanide leaching and such gold is not recovered from the ore. It is believed that as much as 10% of the gold in refractory ore is unrecovered as a result of gypsum encapsulation.

SUMMARY OF THE INVENTION

A method of recovering gold from refractory ore is provided. The method comprises heating refractory ore containing a sulfide and gold to form a hot ore; quenching the hot ore with an aqueous liquid containing a sulfate and calcium to form a hot liquid slurry; adjusting the pH of the hot liquid slurry to form a basic slurry; adding cyanide to the basic slurry to extract gold as a concentrated solution; and recovering the gold from the concentrated solution. The improvement provided by the method comprises adding gypsum seed crystals after the heating step and before the cyanide addition step in an amount sufficient to decrease gypsum encapsulation of gold.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
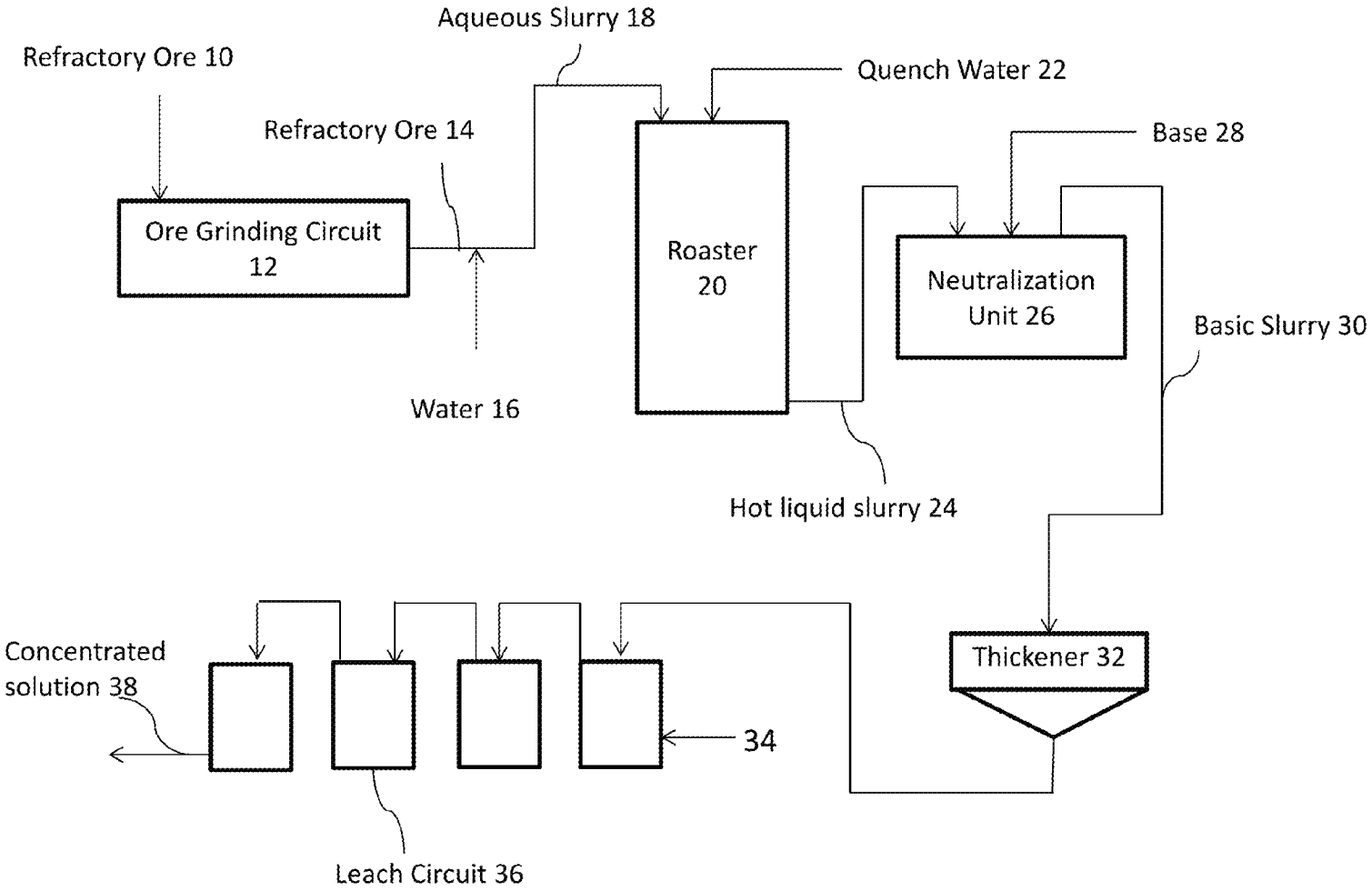
FIG. 1 is a schematic of a system for recovering gold from refractory ore in which the ore is roasted.

In a method of recovering gold from refractory ore, refractory ore containing a sulfide and gold is heated to form a hot ore. The hot ore is quenched with an aqueous liquid containing a sulfate and calcium to form a hot liquid slurry. The pH of the hot liquid slurry is adjusted to form a basic slurry. Cyanide is added to the basic slurry to extract gold as a concentrated solution, and the gold is recovered from the concentrated solution. It has been discovered that gold recovery by this method can be increased by adding gypsum seed crystals after the heating step and before the cyanide addition step to decrease gypsum encapsulation of gold.

In conventional gold recovery processes, the hot ore is quenched with process water which contains sources of calcium and sulfate. The hot ore may also contain calcium oxides and sulfur oxides ($SO_x$). Gypsum ($CaSO_4.2H_2O$) is formed during quenching, and the hot liquid slurry can be supersaturated with gypsum. Supersaturation with gypsum can lead to gypsum deposition and scale formation within equipment used in processing, handling and transporting ore, which can damage the equipment. Thus in conventional gold recovery processes, gypsum precipitation occurs but is undesirable and is to be avoided.

In view of the problems that can arise from gypsum precipitation in the gold recovery process, the addition of gypsum seed crystals was counterintuitive since it would have been expected to increase gypsum precipitation and scaling.

Without being bound by a particular theory, it is believed that the high surface area of the gypsum seed crystals minimizes nucleation and precipitation of gypsum onto ore because the gypsum in the hot ore or the hot liquid slurry precipitates onto the gypsum seed crystals rather than onto the ore.

The method results in recovery of greater than 0.4 wt. % gold based on the total weight of the refractory ore. For example, from about 0.2 to about 2 wt. % gold based on the total weight of the refractory ore can be recovered.

The method of the invention can be added to a conventional process for recovering gold from refractory ores. Such a process includes an ore grinding circuit for reducing the size of the refractory ore, a roaster or autoclave for oxidation of the refractory ore to remove sulfide and expose gold within the ore, a neutralization unit for increasing pH of the slurry, a cyanide leaching circuit for removing gold from the slurry, and a separations unit for separating a gold-containing liquid from leached solids and precipitating gold from the liquid to recover the gold.

Refractory gold ores contain relatively fine gold particles imbedded within a sulfide mineral. Cyanide cannot penetrate or dissolve the sulfide ore so the gold is not recovered by traditional leaching methods. Some ores contain carbonaceous material, such as granular carbon, to which the gold cyanide complex formed during leaching becomes bound. This gold cannot be recovered from the leach solution and remains bound to the carbon grains in the leached tailings.

Refractory ore to be treated using the methods of the invention contain a sulfide and gold. The refractory ore can contain a carbonaceous material such as grains of carbon. The sulfide can be pyrite ($FeS_2$), arsenian pyrite or arsenopyrite (FeAsS).

In FIG. 1, a typical system for recovering gold from refractory ore via a roasting process is depicted. Refractory ore 14 is fed to an ore grinding circuit 16 in which the ore is grinded down in size to form ground ore 18 having an average particle size of less than about 100 microns (the actual optimal particle size is dependent on the gold distribution within the ore). Any known grinding method can be used to reduce the particle size of the refractory ore.

In the case of roasting at atmospheric pressure, following particle size reduction, the ground ore 18, which contains a sulfide, gold and optionally a carbonaceous material, is fed into a roaster 20 where the refractory ore is roasted at a temperature ranging from 450° C. to about 700° C. (typically about 535-540° C.) to form a hot ore (not shown). Roasting removes sulfides from the ore by oxidizing the sulfides to form water soluble sulfates and sulfur dioxide. Oxidation also converts some calcium minerals to calcium oxide. The oxidation generates a porous matrix in the roasted refractory ore and exposes gold in the matrix as a result of removal of sulfides from the matrix.

Once the ore is roasted, quench water 22 is added to the hot ore. The quench water comprises an aqueous liquid containing a sulfate and calcium.

Quenching of the hot ore forms a hot liquid slurry 24 which is fed to neutralization unit 26. The pH of the hot liquid slurry 24 is increased in the neutralization unit by addition of a base 28 to form a basic slurry 30. The basic slurry has a pH from about 8 to about 14, about 10.5 to about 14, and more preferably about 11. Bases typically used to adjust pH of the hot liquid slurry include, but are not limited to, lime, calcium hydroxide, sodium hydroxide, and calcium oxide. Adjustment of the pH of the slurry avoids formation of toxic hydrogen cyanide.

The basic slurry 30 is optionally fed to a thickener unit 32 to concentrate the slurry prior to leaching.

Alternatively, the pH adjustment of the slurry in the neutralization unit 26 may take place after the slurry is fed to the thickener unit 32 (i.e., the thickener unit 32 can be upstream of the neutralization unit 26).

The basic slurry 30 or the concentrated basic slurry and a cyanide stream 34 are fed to a leach circuit 36. Gold exposed in the matrix of the refractory ore after sulfide removal comes into direct contact with the cyanide stream in the leach circuit. The gold combines with cyanide to form a complex which is extracted as a concentrated solution 38. The concentrated solution of gold is processed by conventional means such as separation of the gold-containing liquid from solids and zinc precipitation of the gold-containing liquid to recover the gold as a solid. Alternatively, the concentrated solution could also be processed by conventional methods using activated carbon to absorb the gold cyanide complex.

Gypsum seed crystals can be added to the system shown in FIG. 1 before the quenching step. For example, the seed crystals can be added directly to the ground ore 18.

Gypsum seed crystals can be added to the system during the quenching step. For example, the seed crystals can be added to the quench water 22 or can be added directly to the roaster 20.

Gypsum seed crystals can be added to the system after the quenching step. The seed crystals can be added to the hot liquid slurry 24 before it enters the neutralization unit 26.

Gypsum seed crystals can be added to the system during the pH adjusting step. The seed crystals can be added to the base 28, or directly to the neutralization unit 26.

Gypsum seed crystals can be added to the system after the pH adjusting step. For example, the seed crystals can be added to the basic slurry 30, or if applicable, to the concentrated basic slurry, before the slurry is fed to the leach circuit 36.

The amount of gypsum seed crystals effective in reducing gypsum encrustation of the gold ore is dependent on the particle size of the gypsum seed crystals and the expected level of gypsum supersaturation in the quench stage. For example, 25 micron size gypsum seed crystals may be added in an amount of 10 g/Liter to the quench stage of a typical roasted refractory ore utilizing gypsum saturated quench water. The optimal seed crystal dose can be determined experimentally.

Gypsum seed crystals are widely available from many commercial sources.

Figure 2:
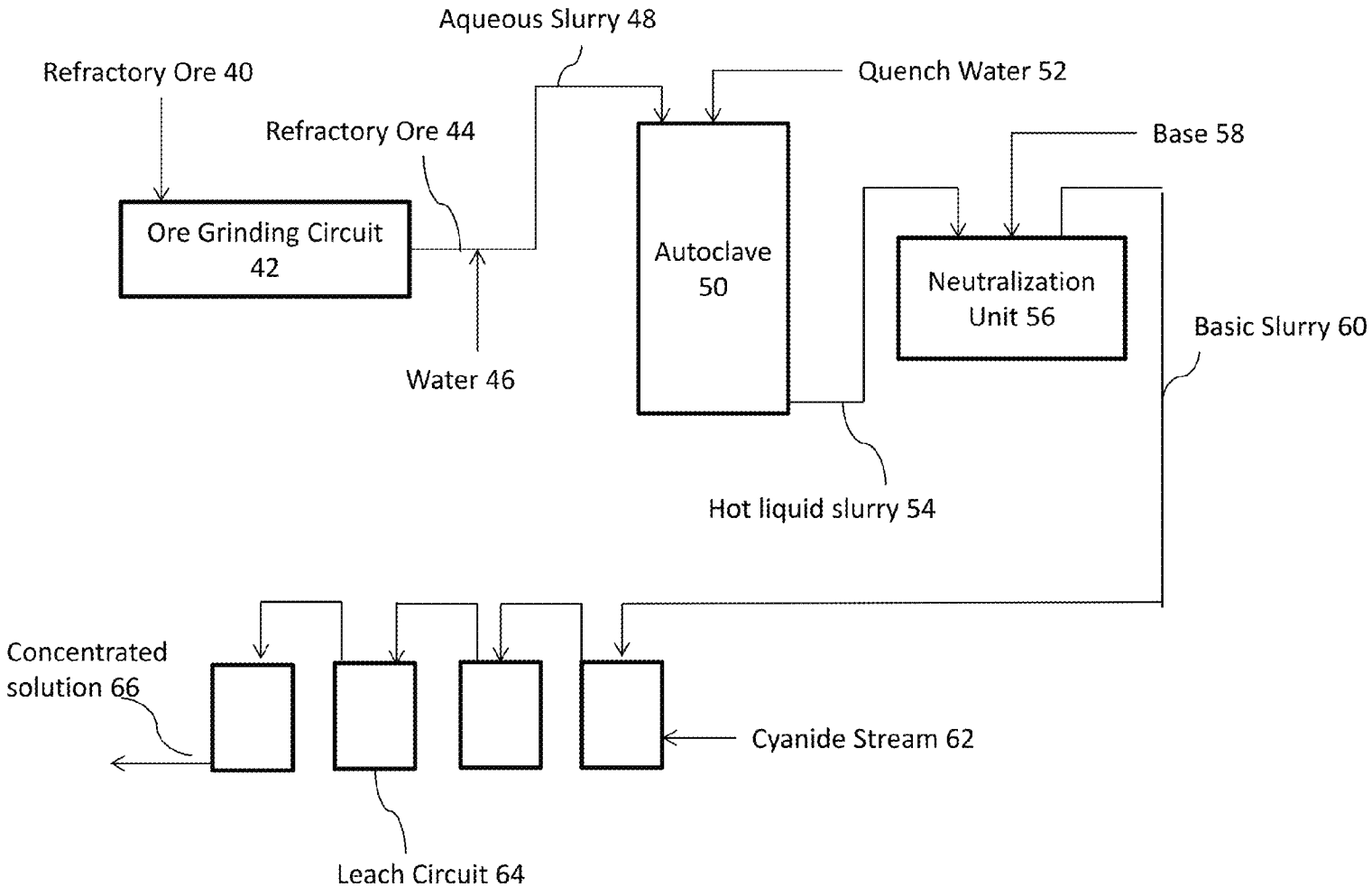
FIG. 2 is a schematic of a system for recovering gold from refractory ore in which the ore is autoclaved.

In an alternative gold recovery process shown in FIG. 2, gold is recovered from refractory ore via a pressure oxidation process. Refractory ore 40 is fed to an ore grinding circuit 42 in which the ore is grinded down in size to form ground ore 44 having an average particle size of less than about 150 microns. Any known grinding method can be used to reduce the particle size of the refractory ore.

In this process a wet grinding step can be used so the water can be added before, during or after the grinding step. Following particle size reduction, the ground ore 44, which contains a sulfide, gold and optionally a carbonaceous material, is mixed with water 46 to form an aqueous slurry 48. The water 46 can be process water which contains calcium and sulfate.

Alternatively, the water 46 can be mixed with the refractory ore 40 before the ore is fed to the ore grinding circuit 42 (not shown), such that the aqueous slurry 48 contains the ground ore.

As another alternative, the water 46 can enter the ore grinding circuit 42 (not shown) so that the water is mixed with the refractory ore 40 within the ore grinding circuit 42, such that the aqueous slurry 48 contains the ground ore.

The aqueous slurry 48 is fed into an autoclave 50 where the refractory ore is oxidized at a temperature ranging from about 180° C. to about 250° C. (typically about 230-235° C.) and a pressure ranging from about 1,000 kPa to about 3,000 kPa (typically about 2,000 kPa) to form a hot ore slurry (not shown). Pressure oxidation removes sulfides from the ore by oxidizing the sulfides to form water soluble sulfates and sulfur dioxide. The oxidation dissolves the matrix that encapsulates the gold within the refractory ore and exposes gold in the matrix as a result of removal of sulfides from the matrix.

Once the ore is pressure oxidized, quench water 52 is added to the hot ore slurry. The quench water comprises an aqueous liquid containing a sulfate and calcium.

Quenching of the hot ore slurry forms a hot liquid slurry 54 which is fed to neutralization unit 56. The pH of the hot liquid slurry 54 is increased in the neutralization unit by addition of a base 58 to form a basic slurry 60. The basic slurry has a pH from about 8 to about 14, about 10.5 to about 14, and more preferably about 11. Bases typically used to adjust pH of the hot liquid slurry include, but are not limited to, lime, calcium hydroxide, sodium hydroxide, and calcium oxide. Adjustment of the pH of the slurry avoids formation of toxic hydrogen cyanide.

The basic slurry 60 and a cyanide stream 62 are fed to a leach circuit 64. Gold exposed in the matrix of the refractory ore after sulfide removal comes into direct contact with the cyanide stream in the leach circuit. The gold combines with cyanide to form a complex which is extracted as a concentrated solution 66. The concentrated solution of gold is processed by conventional means such as separation of the gold-containing liquid from solids and zinc precipitation of the gold-containing liquid to recover the gold as a solid. The concentrated solution could also be processed by conventional methods using activated carbon to absorb the gold cyanide complex.

Gypsum seed crystals can be added to the system shown in FIG. 2 before the quenching step. For example, the seed crystals can be added directly to the ground ore 44 or the aqueous slurry 48, or can be added to the water stream 46 to introduce the seed crystals into the aqueous slurry 48.

Gypsum seed crystals can be added to the system during the quenching step. For example, the seed crystals can be added to the quench water 52 or can be added directly to the autoclave 50. For the quench stage it is probably best to add the gypsum seed crystals in with the quench water.

Gypsum seed crystals can be added to the system after the quenching step. The seed crystals can be added to the hot liquid slurry 54 before it enters the neutralization unit 56.

Gypsum seed crystals can be added to the system during the pH adjusting step. The seed crystals can be added to the hot liquid slurry 54, or directly to the neutralization unit 56.

Gypsum seed crystals can be added to the system after the pH adjusting step. For example, the seed crystals can be added to the basic slurry 60 before the slurry is fed to the leach circuit 64.

The amount of gypsum seed crystals effective in reducing gypsum encrustation of the gold ore is dependent on the particle size of the gypsum seed crystals and the expected level of gypsum supersaturation in the quench stage. The level of gypsum supersaturation depends on the sulfate and calcium content of the ore and the amount of quench water evaporation from adding the quench water to the hot liquid slurry. Thus, gypsum supersaturation depends upon the composition of the ore, the temperature of the ore exiting the roaster or the autoclave, and the efficiency of the roaster or autoclave.

Gypsum seed crystals can be added in an amount of 1 to 100 grams per liter of the hot ore slurry, the hot liquid slurry, or the basic slurry. For example, 25 micron size gypsum seed crystals may be added in this process in an amount of 10 g/Liter to the quench stage of a typical autoclaved refractory ore utilizing gypsum saturated quench water. The optimal seed crystal dose can be determined experimentally.

An optional scale inhibitor can be added before the cyanide addition step in an amount sufficient to decrease precipitation of gypsum in the hot ore slurry, the hot liquid slurry 24 or 54, or the basic slurry 30 or 60.

The scale inhibitor can be any compound or composition effective in inhibiting gypsum precipitation. Gypsum scale inhibitors are known to those skilled in the art. Such scale inhibitors include, but are not limited to, a phosphonate, a polyacrylic acid, a copolymer of acrylic acid and acrylamide, a copolymer of acrylic acid and 2-acrylamido-2-methylpropylsulfonic acid (AMPS), a copolymer of acrylamide and AMPS, or a combination thereof. The scale inhibitor is used in an amount effective in inhibiting gypsum precipitation, such as an amount ranging from 0.5 to 5 ppm based on the hot ore slurry, the hot liquid slurry or the basic slurry.

Having described the invention in detail, it will be apparent that modifications and variations are possible without departing from the scope of the invention defined in the appended claims.

EXAMPLES

The following non-limiting examples are provided to further illustrate the present invention.

Example 1

A dry grinding operation processing 6000 tons per day of a refractory ore is fed to a fluidized bed roaster and is oxidized at 500-600° C. to convert sulfide minerals to $SO_2$ and carbon to $CO_2$. The temperature of the hot ore is reduced using quench water which is added directly to the hot ore. Quench water addition results in the evaporation of a portion of the water as steam. After quench water addition, the ore is transported to a two stage neutralization system as an ore slurry. In the two neutralization stages, lime is added to the ore slurry to raise the pH. In the first stage, the pH is raised to about 8 and in the second stage the pH is raised to about 10. After neutralization the ore slurry is fed to a thickener and the concentrated underflow is treated with cyanide to solubilize the gold for subsequent recovery.

The water used to quench the ore is recycled process water which contains 485 ppm dissolved calcium and 2420 ppm dissolved sulfate. At 25° C. the quench water is saturated with respect to gypsum. If a portion of this water is evaporated or if calcium and/or sulfate is added then the water becomes supersaturated with respect to gypsum and gypsum precipitation can occur. Gypsum encapsulation of the ore particles occurs in the hot ore quench stage and in the neutralization stages. Cyanide is prevented from contacting these gold grains and solubilizing the encapsulated gold. This gold is unrecovered and remains in the discarded tailings.

Addition of 10 grams/Liter gypsum to the quench water prior to addition of the ore directs gypsum precipitation in the quench stage away from the gold ore particles and onto the gypsum seed crystals. This gypsum also helps limit encapsulation of gypsum on the gold ore in the two neutralization stages. In these stages, however, the gypsum supersaturation is higher than in the quench stage so an additional 5 grams/liter gypsum is added to the two neutralization stages. Elimination of gypsum encapsulation of the gold ore increases gold dissolution in the cyanide treatment stage and subsequent gold recovery increases by greater than 0.4% as compared to the same process without use of gypsum seed crystals.

Example 2

Calcite and gypsum were tested as potential seeding sources. Three samples of gypsum supersaturated water were prepared by adding 2.674 grams calcium hydroxide solid to sodium sulfate solution containing 3,500 ppm sulfate. A gypsum-seeded sample was prepared containing 900 grams of the gypsum supersaturated water and 100 grams of powdered gypsum. A calcite-seeded sample was prepared containing 900 grams of the gypsum supersaturated water and 100 grams of calcite (calcium carbonate) powder. An unseeded control sample contained 900 grams of the gypsum supersaturated water and no seed solids.

Figure 3:
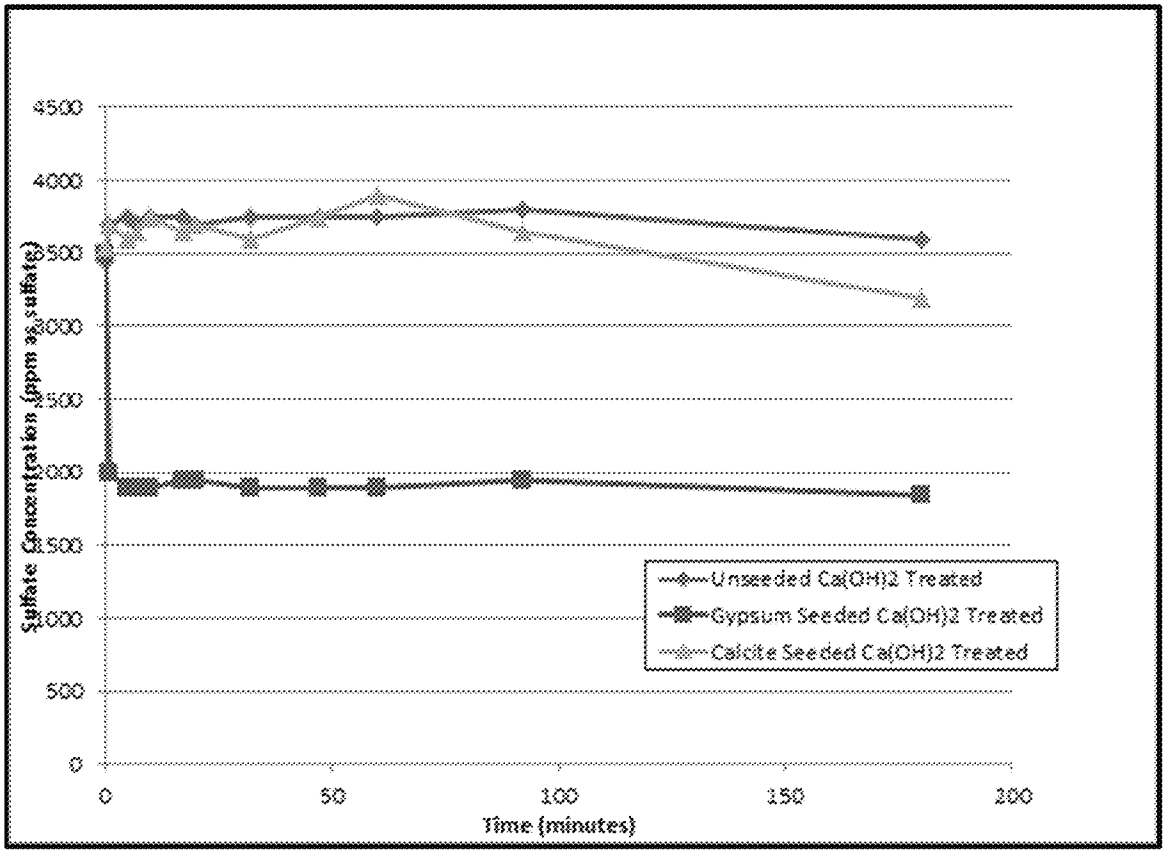
FIG. 3 is a graph of sulfate concentration over time for a gypsum-seeded sample (—■—), a calcite-seeded sample (—▲—) and an unseeded sample (—◆—) of gypsum supersaturated water.

Filtered portions of the three stirred samples were collected over about 3 hours and analyzed to determine sulfate concentration. Results are shown in FIG. 3.

The precipitation reaction progressed rapidly and sulfate was efficiently removed from the gypsum-seeded sample. Such rapid incorporation of sulfate onto the gypsum crystal surface will allow the gypsum seed to reduce gypsum crystal formation on gold containing ore.

The precipitation was more rapid with the calcite-seeded sample than in the unseeded sample, but was still much slower than in the gypsum-seeded sample. Although the high calcite surface area may act as a template for gypsum nuclei formation and subsequent crystal growth to allow sulfate removal, the rate of sulfate removal was low as compared to the gypsum-seeded sample, showing that use of a non-gypsum surface will be less effective at redirecting crystal formation away from gold ore to reduce gypsum encapsulation on gold ore.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods without departing from the scope of the invention, it is intended that all matter contained in the above description and shown in the accompanying drawings shall be interpreted as illustrative and not in a limiting sense.

What is claimed is:

1. A method of recovering gold from refractory ore comprising:

heating refractory ore containing a sulfide and gold to form a hot ore;

quenching the hot ore with an aqueous liquid containing a sulfate and calcium to form a hot liquid slurry;

adjusting the pH of the hot liquid slurry to form a basic slurry;

adding cyanide to the basic slurry to extract gold as a concentrated solution; and recovering the gold from the concentrated solution, the improvement comprising:

adding gypsum seed crystals after the heating step and before the cyanide addition step in an amount sufficient to decrease gypsum encapsulation of gold.

2. The method of claim 1, wherein the gypsum seed crystals are added before the quenching step.

3. The method of claim 1, wherein the gypsum seed crystals are added during the quenching step.

4. The method of claim 1, wherein the gypsum seed crystals are added after the quenching step.

5. The method of claim 1, wherein the gypsum seed crystals are added before the pH adjusting step.

6. The method of claim 1, wherein the gypsum seed crystals are added during the pH adjusting step.

7. The method of claim 1, wherein the gypsum seed crystals are added after the pH adjusting step.

8. The method of claim 1, wherein the refractory ore further contains a carbonaceous material.

9. The method of claim 8, wherein the carbonaceous material comprises elemental carbon or an organic carbon material.

10. The method of claim 1, wherein the sulfide comprises pyrite, arsenian pyrite or arsenopyrite.

11. The method of claim 1, wherein the refractory ore is heated in an aqueous slurry and the hot ore is a hot ore slurry.

12. The method of claim 1, further comprising the step of adding a scale inhibitor before the cyanide addition step in an amount sufficient to decrease precipitation of gypsum in the hot ore slurry, the hot liquid slurry, or the basic slurry.

13. The method of claim 12, wherein the scale inhibitor comprises a phosphonate, a polyacrylic acid, a copolymer of acrylic acid and acrylamide, a copolymer of acrylic acid and 2-acrylamido-2-methylpropylsulfonic acid (AMPS), a copolymer of acrylamide and AMPS, or a combination thereof.

14. The method of claim 1, wherein greater than 0.4 wt. % gold based on the total weight of the refractory ore is recovered.

15. The method of claim 1, wherein from about 0.2 to about 2 wt. % gold based on the total weight of the refractory ore is recovered.

16. The method of claim 1, wherein the gypsum seed crystals are added in the amount of 1 to 100 grams per liter of the hot ore slurry, the hot liquid slurry, or the basic slurry.

17. The method of claim 1, wherein the heating step further comprises roasting the refractory ore at a temperature ranging from about 250° C. to about 1000° C.

18. The method of claim 1, wherein the heating step further comprises subjecting the refractory ore in an aqueous slurry to oxygen at a temperature ranging from about 180° C. to about 250° C. and a pressure ranging from about 500 kPa to about 5000 kPa in an autoclave.

19. The method of claim 1, wherein in the pH adjusting step, the pH is adjusted to be in the range from about 8 to about 14.

20. The method of claim 19, wherein in the pH adjusting step, the pH is adjusted to be in the range from about 10.5 to about 14.

* * * * *